US005430619A

United States Patent [19]

Lindenbaum

[11] Patent Number: 5,430,619

[45] Date of Patent: Jul. 4, 1995

[54] TERMINAL BOX

[75] Inventor: Matthew J. Lindenbaum, Ottawa, Ill.

[73] Assignee: Lindenbaum Systems Design, Inc., Ottawa, Ill.

[21] Appl. No.: 214,532

[22] Filed: Mar. 18, 1994

[51] Int. Cl.[6] ..... H01R 9/00

[52] U.S. Cl. ..... 361/823; 361/641

[58] Field of Search ..... 361/611, 637, 641, 648–649, 361/823; 174/68.1, 68.2, 70 B, 71 B, 72 B, 88 B, 99 B, 149 B, 267

[56] References Cited

U.S. PATENT DOCUMENTS 3,644,870 2/1972 Jones .

*Primary Examiner*—Bot L. Ledynh
*Attorney, Agent, or Firm*—Ernest Kettelson

[57] ABSTRACT

A terminal box comprising a block of non-conductive material such as polystyrene or other comparable material having a first bus bar embedded therein with terminal connections to connect the live or hot wire of a first circuit leading to an electrical source, of a second circuit leading to a first load, and of a third or more circuits leading to a second or more load, a second bus bar embedded therein with terminal connections to connect the neutral wire of the first circuit leading to the electrical source, of the second circuit leading to the first load, and of the third or more circuits leading to a second or more load, and a third bus bar embedded therein with terminal connections to connect the ground wire of the first, second, third or more circuits. The terminal box includes an access cavity for access to releasable securing member to releasably secure the electrical wires to their respective terminal connections, such as tightening screws, and a non-conductive cover plate to cover the access cavity when in place and to provide access thereto when removed.

11 Claims, 4 Drawing Sheets

TERMINAL BOX

BACKGROUND OF THE INVENTION

This invention relates to the field of terminal boxes to make electrical connections.

Prior art devices of this kind of which the inventor is aware include those which are described and shown in the following United States patents.

U.S. Pat. No. 4,593,960 discloses a power entry connector for bringing power to an electrical distribution system mounted in modular wall panels, comprising a housing, means in the housing to retain contacts which have tabs that extend outwardly from the housing, a spring mounted cover on the housing to cover the tabs when not operational and to be slidably moved to expose the tabs in an operational state.

U.S. Pat. No. 4,358,815 discloses branch circuit connectors secured to vertical bus bars having spaced pairs of upstanding threaded posts flanked by pairs of upstanding pins to receive the line side connectors of bolt-in or plug-in circuit breakers.

U.S. Pat. No. 3,644,870 discloses an auxiliary distribution bypass apparatus for use with a main electrical power distribution panel, including an auxiliary panel located in spaced relation with respect to the main panel and having distributor circuit plug-in connectors and transfer switches with associated wiring for transferring distributor circuits extending from the main panel to the distributor plug-in connectors, and a portable distribution panel having a main power input and distribution circuits terminating in plug-in type connector members, also including a plurality of patch cable assemblies for selective interconnection between the plug-in connector members of the portable distribution panel and the auxiliary panel plug-in connectors.

SUMMARY OF THE INVENTION

The terminal box in accordance with the present invention includes a number of improvements over the prior art.

Connections of branch load circuits to a circuit leading to a power source are now made by use of a junction box, usually of electrically conductive metal, and connectors which secure the conductors leading from each circuit to the junction box. The respective wires of each circuit which extend into the junction box are stripped back and coupled together either by wire nuts or soldering or both. Soldered connections are taped with electrical insulating tape, and some electricians even tape the wire nut connections.

Over a period of time, such prior art connections can and do separate enough to create problems such as arcing and short circuits that can cause a fire, as well as to render the down stream circuit non-conductive. The electrical code requires that prior art junction boxes cannot be hidden or placed within walls, ceilings or below floors in such a way that access cannot be obtained to such junction boxes because of the foregoing problems and hazards inherent in the prior art method of connecting branch load circuits to an electrical supply circuit.

The present invention solves such problems. It provides an electrically non-conductive box having conductive bus bars embedded therein that each have terminals for connection of respective wires from the circuit leading to the electrical source at one end of each bus bar. Each bus bar also has one or more additional terminals for connection of respective wires of the circuit leading to one or more loads.

The terminal box is made of a solid non-conductive material such as polystyrene, having an open end wall for access to longitudinal passageways which are in registration with wire receiving bores of the respective bus bar terminals. The insulated wires of the circuit leading to the electrical source are stripped back and inserted through respective longitudinal passageways of one terminal compartment, the white or neutral wire into the passageway in registration with the wire receiving bore of the bus bar which has terminal connections for that wire of each circuit, the black or hot wire into the passageway in registration with the wire receiving bore of the bus bar which has terminal connections for that wire of each circuit, the ground wire into the passageway in registration with the wire receiving bore of the bus bar which has terminal connections for the ground wire of each circuit to be connected.

The corresponding wires of the circuit leading to a first load are similarly connected to their respective bus bars through longitudinal passageways of a second terminal compartment of the terminal box.

The same may be done for a circuit leading to a second load utilizing a third terminal compartment of the terminal box. The terminal box may be made still larger with any appropriate number of additional compartments for connection of circuits leading to additional loads.

The wires received in the respective wire receiving bores of the corresponding bus bars are secured therein by any convenient means, such as set screws received through threaded taps of the bus bars which intersect the wire receiving bores and which are in registration with corresponding set screw passageways through terminal wall portions of each terminal compartment opening to an access cavity which is covered by a non-conductive cover plate when the connections have been completed.

DESCRIPTION OF PREFERRED EMBODIMENT

Figure 1:
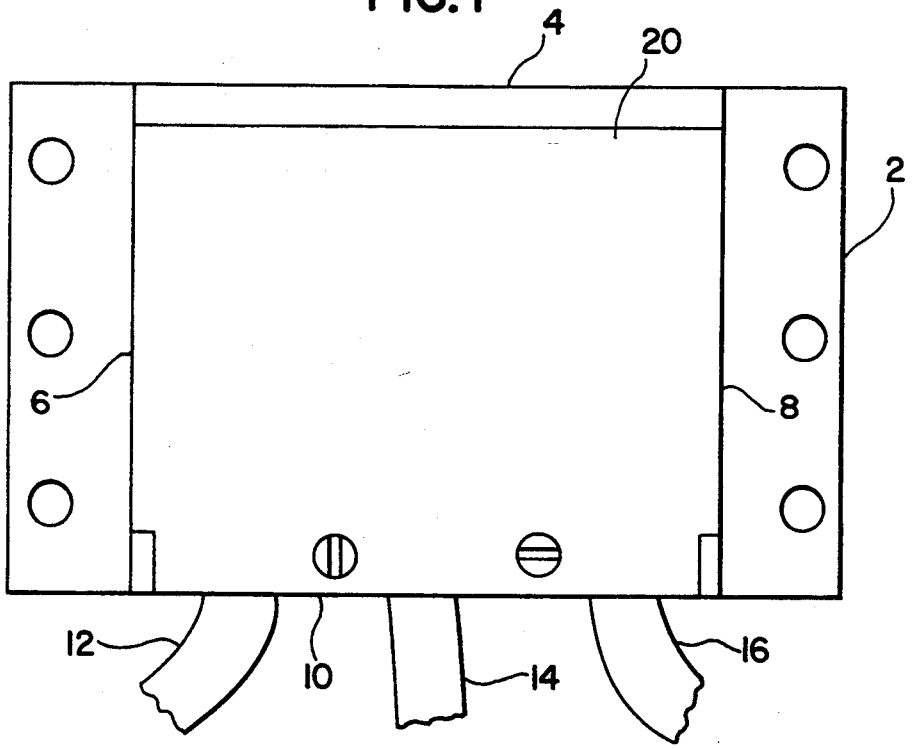
FIG. 1 is a plan view of a terminal box in accordance with this invention.
Figure 2:
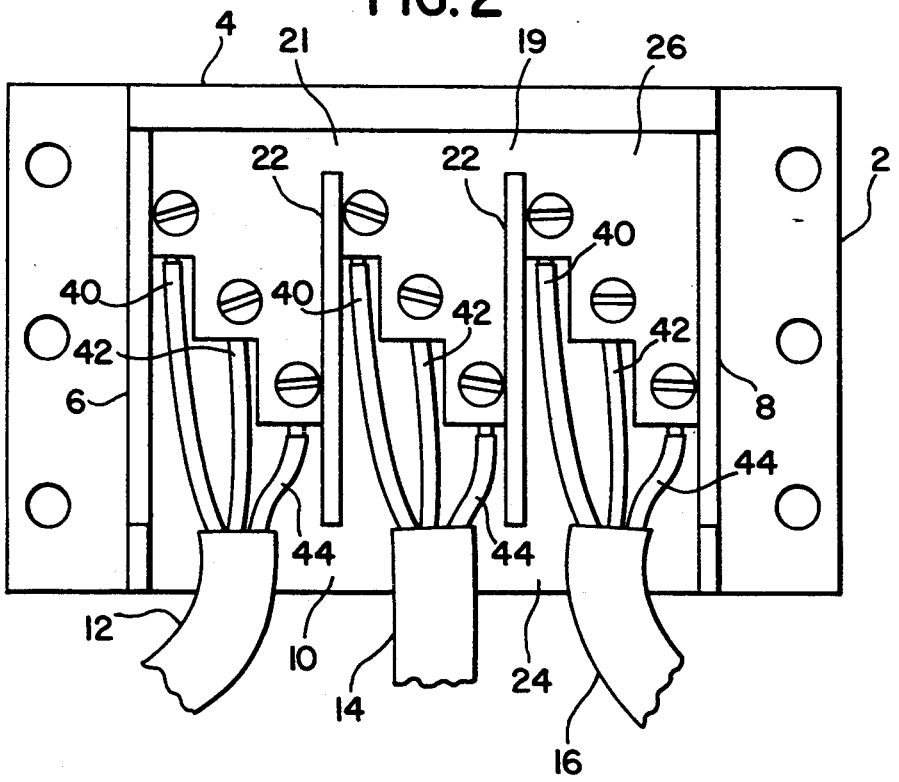
FIG. 2 is a plan view of the terminal box of FIG. 1 with the cover removed.
Figure 5:
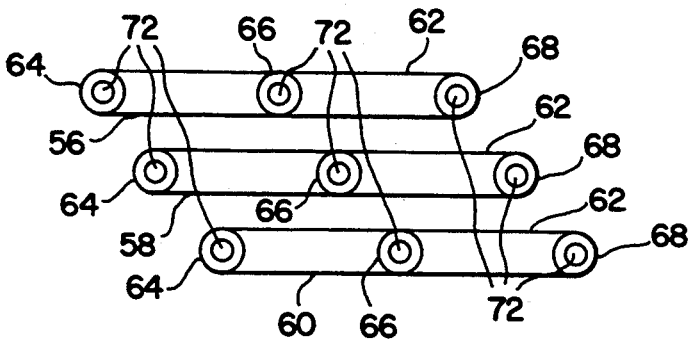
FIG. 5 is a plan view of the bus bars that are embedded within the terminal box, shown in their relative positions but with the terminal box removed to more clearly show the bus bars themselves and their placement relative to each other.
Figure 4:
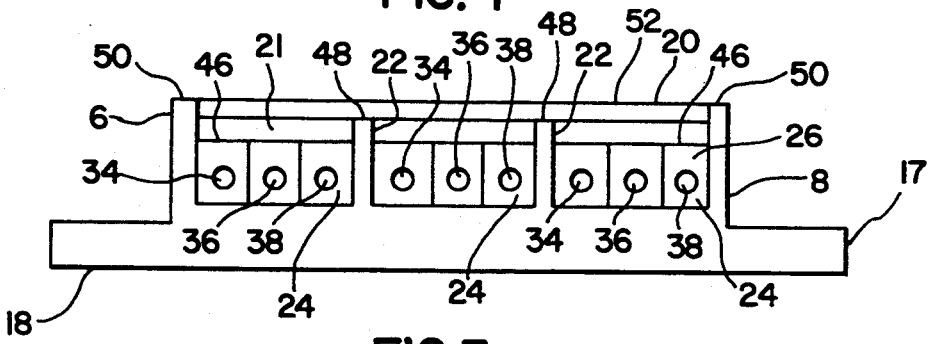
FIG. 4 is an end elevation view of the terminal box of FIG. 3 but with the cover in place.
Figure 3:
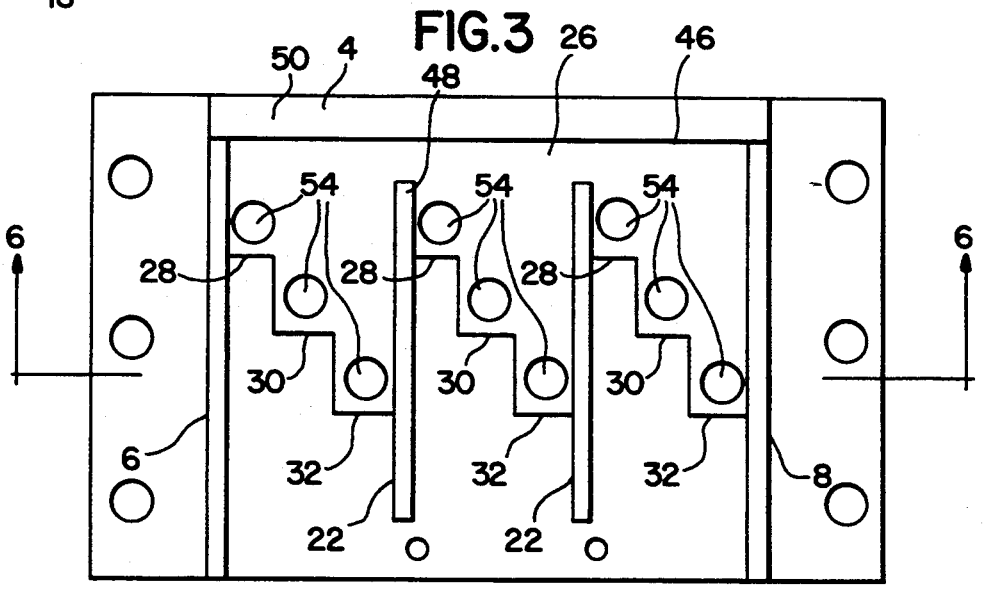
FIG. 3 is a plan view of the terminal box of FIG. 1 and FIG. 2 but with the cover removed and the electrical conductors disconnected.
Figure 6:
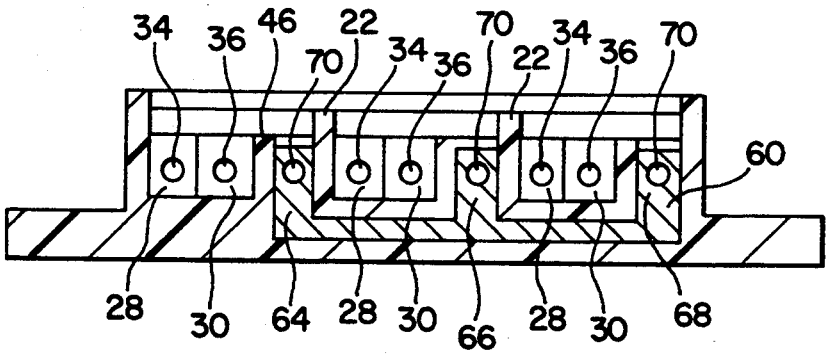
FIG. 6 is a section view taken on line 6—6 of FIG. 3.
Figure 7:
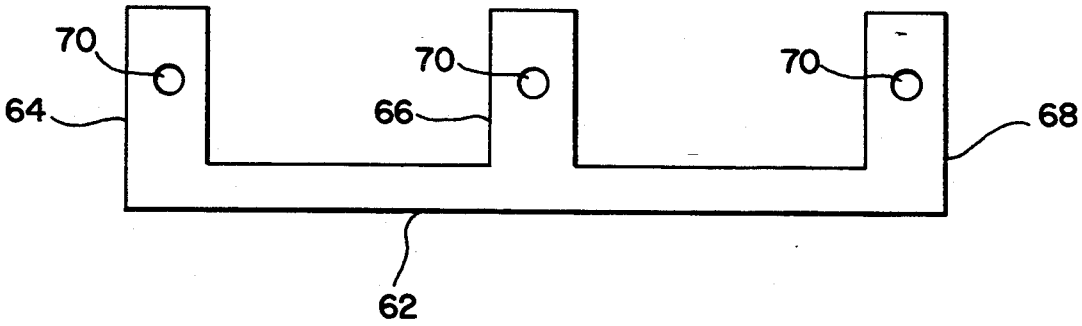
FIG. 7 is an elevation of one of the bus bars to show each of the upwardly extending legs and the wire receiving terminal bore through each.
Figure 8:
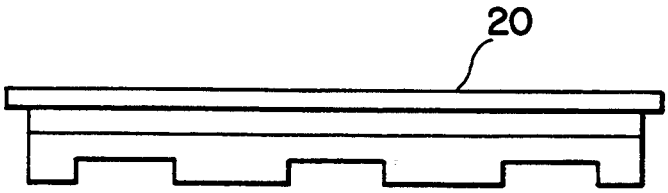
FIG. 8 is an elevation view of the cover for the terminal box.
Figure 9:
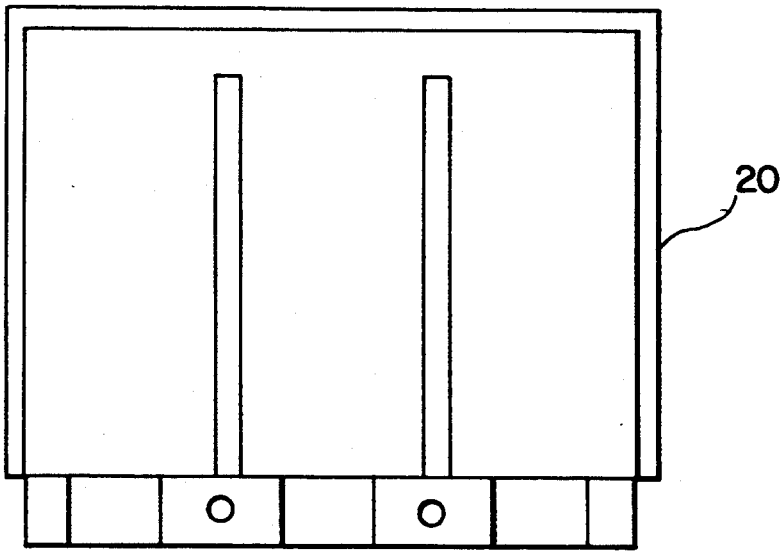
FIG. 9 is a bottom plan view of the cover in accordance with this invention.

A terminal box in accordance with this invention includes a block 2 of electrically non-conductive material such as polystyrene in the form of a rectangle, having a closed end wall 4 preferably about three and one half inches across, a first side wall 6 and opposite second side wall 8 each preferably about three inches long, and an open or entrance end wall 10 to receive electrical conductors 12, 14 and 16 therein for making electrical connections. The open end wall 10 is also preferably about three and one-half inches across.

The end walls and side walls are integrally formed with and extend upwardly from a base 12 which has a longitudinal dimension corresponding to that of the side walls 6 and 8, and an end wall dimension which is preferably about five inches across, thereby extending outwardly from each side wall 6 and 8 three-quarters of an inch.

The base 17 is preferably about one-quarter inch thick, the side walls 6 and 8 and end wall 4 and 10 extend upwardly from the base preferably about three-quarters of an inch. The rectangular block 2 has a solid planar bottom wall 18, and an open top wall 19 with a cover 20 to close the cavity 21 of the block 2 when in place and to provide access to the cavity 21 when the cover 20 is removed.

The cavity 21 is separated by longitudinal ribs 22 into a plurality of compartments, each having a cavity floor 24 extending inwardly from the entrance wall 10 to a raised portion 26 having short upwardly extending and staggered terminal walls 28, 30 and 32, with longitudinal terminal recesses 34, 36 and 38 opening thereto to receive, for example, respective ones of the individual white insulated wire 40, the ground wire 42 and black insulated wire 44 of one of the electrical conductors 12, 14 or 16.

The raised portion 26 has a planar recessed top wall 46 at a level about an eighth of an inch below the upper surface 48 of the longitudinal ribs 22. The upper surface 48 of the longitudinal ribs is in turn about an eighth of an inch below the upper surface 50 of the side walls 6 and 8 and end wall 4. When the cover 20 is put in place between the side walls 6 and 8 and closed end wall 4, resting on the upper surface 48 of the longitudinal ribs 22, the upper surface 52 of the cover 20 is coplanar with the upper surface 50 of the side walls 6 and 8 and end wall 4.

Apertures 54 open to the recessed top wall 46 of the raised portion 26, each positioned to intersect respective ones of the longitudinal terminal recesses 34, 36 and 38 in each of the compartments separated by longitudinal ribs 22.

The rectangular block 2 has a plurality of channels formed therein to receive a corresponding plurality of bus bars, including a first bus bar 56 to receive and connect respective wires 40 received in longitudinal terminal recesses 34 of each of the respective compartments, a second bus bar 58 to receive and connect the respective wire 42 received longitudinal terminal recesses 36, and a third bus bar 60 to receive and connect the respective wires 44 received in longitudinal terminal recess 38.

Each bus bar 56, 58 and 60 comprises an elongated laterally extending portion 62, a first upwardly extending leg 64 at one end, a second upwardly extending leg 66 in the middle and a third upwardly extending leg 68 at the other end. A wire receiving bore 70 extends through each leg 64, 66 and 68 near its upper end and a threaded screw tightening bore 72 opens to the upper end of each leg 64, 66 and 68 and intersects the wire receiving bore 70 of each leg as it extends downwardly from the upper end of each leg.

The upwardly extending legs 64, 66 and 68 of bus bar 56 are received in respective upwardly extending channels which intersect longitudinal terminal recesses 34 in each compartment in line with the respective apertures 54 intersecting each longitudinal recess 34 which opens to the recessed top wall 46 of each raised portion 26. At such time the longitudinal wire receiving bore 70 through each leg of bus bar 56 is in registration with respective ones of the longitudinal terminal recesses 34 in each compartment and the screw tightening bore 72 of each leg is in registration with respective ones of the apertures 54 to receive a set screw therein to secure the wire 40 received in each wire receiving bore 70 of bus bar 56.

The upwardly extending legs 64, 66 and 68 of bus bar 58 are received in respective upwardly extending channels of the rectangular block 2 which intersect longitudinal terminal recesses 36 in each compartment in line with the respective apertures 54 intersecting each longitudinal recess 36 which opens to the recessed top wall 46 of each raised portion 26. At such time, the longitudinal wire receiving bore 70 through each leg of bus bar 58 is in registration with respective ones of the longitudinal recesses 36 in each compartment and the screw tightening bore 72 of each leg is in registration with respective ones of the apertures 54 to receive a set screw therein to secure the wire 42 received in each wire receiving bore 70 of bus bar 58.

The upwardly extending legs 64, 66 and 68 of bus bar 60 are received in respective upwardly extending channels of the rectangular block 2 which intersect longitudinal terminal recesses 38 in each compartment in line with the respective apertures 54 intersecting each longitudinal recess 38 which opens to the recessed top wall 46 of each raised portion 26. At such time, the longitudinal wire receiving bore 70 through each leg of bus bar 60 is in registration with respective ones of the longitudinal recesses 38 in each compartment and the screw tightening bore 72 of each leg is in registration with respective ones of the apertures 54 to receive a set screw therein to secure the wire 44 received in each wire receiving bore 70 of bus bar 60.

In the example given above, the white insulated wire 40 from an electrical source has its free end stripped back a quarter inch or so and is inserted into the terminal recess 34 of a first compartment of the block 2 and into the wire receiving bore 70 of leg 64 of bus bar 56, the ground wire 42 from the electrical source is inserted into the terminal recess 36 of the first compartment of block 2 and into the wire receiving bore 70 of leg 64 of bus bar 58, the black insulated wire 44 from the electrical source is stripped back a quarter of an inch or so and is inserted into the terminal recess 38 of said first compartment of block 2 and into the wire receiving bore 70 of leg 64 of bus bar 60.

Then the white insulated wire 40 leading to a first load is stripped back and inserted into the terminal recess 34 of a second compartment of the block 2 and into the bore 70 of leg 66 of bus bar 56, the ground wire 42 leading to the first load is inserted into the terminal recess 36 of the second compartment of block 2 and into the bore 70 of leg 66 of bus bar 58, the black insulated wire 44 leading to said first load is stripped back and inserted into the terminal recess 38 of the second compartment of block 2 and into the bore 70 of leg 66 of bus bar 60.

Set screws are then tightened down through the apertures 54 and screw tightening bores 72 to secure the wires in place within the respective bores of the respective bus bar legs. The terminal box in accordance with this invention has now completed a connection between an electrical source and a first load.

To connect the same electrical source to a second load, the white insulated wire 40 leading to the second load is stripped and inserted into terminal recess 34 of a third compartment of block 2 and into the bore 70 of leg 68 of bus bar 56, the ground wire 42 leading to the second load is inserted into terminal recess 36 of the third compartment of block 2 and into bore 70 of leg 68 of bus bar 58, the black insulated wire 44 leading to the second load is stripped and inserted into terminal 38 of the third compartment of block 2 and into the bore 70 of leg 68 of bus bar 60.

Screws are tightened down through aperture 54 and the screw tightening bores 72 of legs 68 of bus bar 56, 58 and 60 to secure the wires in their respective wire receiving bores 70. An electrical connection of the second load to the electrical source has now been completed.

Any number of additional loads can be connected to an electrical source by the terminal box in accordance with this invention by providing additional legs to the bus bars and a larger block 2 of polystyrene or other non-conductive material having additional compartments and terminal recesses as described.

I claim:

1. A terminal box to connect electrical conductors, comprising an electrically non-conductive block, a first bus bar within said non-conductive block, first wire connection means to connect a first electrical wire to said first bus bar at a first location thereon, second wire connection means to connect a second electrical wire to said first bus bar at a second location thereon spaced apart from said first location on said first bus bar, a second bus bar within said non-conductive block spaced apart from said first bus bar, third wire connection means to connect a third electrical wire to said second bus bar at a first location thereon, and fourth wire connection means to connect a fourth electrical wire to said second bus bar at a second location thereon spaced apart from said first location on said second bus bar, said first electrical wire and said third electrical wire being in an electrical circuit and extending from an electrical source, said second electrical wire and said fourth electrical wire being in an electrical circuit and leading to a first load, said non-conductive block having a first terminal portion and a spaced apart second terminal portion, said first wire connection means for connection to said first bus bar and said third wire connection means for connection to said second bus bar being located in said first terminal portion of said block, said second wire connection means on said first bus bar and said fourth wire connection means on said second bus bar being located in said second terminal portion of said block.

2. A terminal box as set forth in claim 1, including fifth wire connection means to connect a fifth electrical wire to said first bus bar at a location spaced apart from said first and second wire connection means, sixth wire connection means to connect a sixth electrical wire to said second bus bar at a location spaced apart from said third and fourth wire connection means, said fifth electrical wire and said sixth electrical wire being in an electrical circuit and leading to a second load, said non-conductive block having a third terminal portion spaced apart from said first and second terminal portions, said fifth wire connection means for connection to said first bus bar and said sixth wire connection means for connection to said second bus bar being located in said third terminal portion of said block.

3. A terminal box as set forth in claim 1, including a third bus bar within said non-conductive block, first ground wire connection means to connect a first ground wire in said electrical circuit with said first and third electrical wires to said third bus bar at a first location thereon, second ground wire connection means to connect a second ground wire in said electrical circuit with said second and fourth electrical wires to said third bus bar at a second location spaced apart from said first location on said third bus bar, said first ground wire connection means for connection to said third bus bar being located in said first terminal portion of said block, said second ground wire connection means for connection to said third bus bar being located in said second terminal portion of said block.

4. A terminal box as set forth in claim 2, including a third bus bar within said non-conductive block, first ground wire connection means to connect a first ground wire in said electrical circuit with said first and third electrical wires to said third bus bar at a first location thereon, second ground wire connection means to connect a second ground wire in said electrical circuit with said second and fourth electrical wires to said third bus bar at a second location spaced apart from said first location on said third bus bar, third ground wire connection means to connect a third ground wire in said electrical circuit with said fifth and sixth electrical wires to said third bus bar at a third location spaced apart from said first and second locations on said third bus bar, said first ground wire connection means for connection to said third bus bar being located in said first terminal portion of said block, said second ground wire connection means for connection to said third bus bar being located in said second terminal portion of said block, and said third ground wire connection means for connection to said third bus bar being located in said third terminal portion of said block.

5. A terminal box as set forth in claim 1, wherein said first wire connection means comprises a first leg on said first bus bar, a wire receiving bore in said first leg, said first leg being within said electrically non-conductive block, a first passageway in said block opening to an outwardly facing wall portion thereof for reception of said first wire therethrough, said first passageway extending to and in registration with said wire receiving bore in said first leg of said first bus bar, and securing means to secure and electrically connect said first wire to said first leg on said first bus bar.

6. A terminal box as set forth in claim 5, wherein said second wire connection means comprises a second leg on said first bus bar, a wire receiving bore in said second leg, said second leg being within said electrically non-conductive block, a second passageway in said block opening to an outwardly facing wall portion thereof for reception of said second wire therethrough, said second passageway extending to and in registration with said wire receiving bore in said second leg of said first bus bar, and securing means to secure and electrically connect said second wire to said second leg on said first bus bar.

7. A terminal box as set forth in claim 6, wherein said third wire connection means comprises a first leg on said second bus bar, a wire receiving bore in said first leg of said second bus bar, said first leg of said second bus bar being within said electrically non-conductive block, a third passageway in said block opening to an outwardly facing wall portion thereof for reception of said third wire therethrough, said third passageway extending to and in registration with said wire receiving bore in said first leg of said second bus bar, and securing means to secure and electrically connect said third wire to said first leg of said second bus bar.

8. A terminal box as set forth in claim 7, wherein said fourth wire connection means comprises a second leg on said second bus bar, a wire receiving bore in said second leg of said second bus bar, said second leg of said second bus bar being within said electrically non-conductive block, a fourth passageway in said block opening to an outwardly facing wall portion thereof for reception of said fourth wire therethrough, said fourth passageway extending to and in registration with said wire receiving bore in said second leg of said second bus bar, and securing means to secure and electrically connect said fourth wire to said second leg of said second bus bar.

9. A terminal box as set forth in claim 8, wherein said securing means to secure and electrically connect said first, second, third and fourth wires to respective ones of said first and second legs of said first and second bus bars includes a threaded screw receiving passageway in each of said legs of said first and second bus bars which intersects respective ones of said wire receiving bores and which opens to an outwardly facing surface of each of said legs, a plurality of screw entrance passageways in said electrically non-conductive block opening to an outwardly facing portion thereof, respective ones of said screw entrance passageways extending to and in registration with respective ones of said threaded screw receiving passageways, and a set screw for each of said screw receiving passageways to tighten against and hold respective ones of said wires when received in said wire receiving bores in each of said legs of said first and second bus bars.

10. A terminal box as set forth in claim 8, wherein said first and third passageways in said block opening to an outwardly facing wall portion thereof are located in said first terminal portion of said electrically non-conductive block, said second and fourth passageways in said block opening to an outwardly facing wall portion thereof are located in said second terminal portion of said block.

11. A terminal box as set forth in claim 9, wherein said electrically non-conductive block is substantially rectangular having a bottom wall, opposite side walls, a closed end wall, an open end wall, and an open top wall, a cover to close said open top wall when in place and to open said top wall when said cover is moved away, said terminal portions being below said cover, said first and third passageways of said first terminal portion and said second and fourth passageways of said second terminal portion opening toward said open end wall, said terminal portions having an upwardly facing surface facing toward said open top wall and its said cover when in place, said screw entrance passageways of said electrically non-conductive block opening to said upwardly facing surface of said terminal portions.

* * * * *